US009841212B2

(12) United States Patent
Xu et al.

(10) Patent No.: US 9,841,212 B2
(45) Date of Patent: Dec. 12, 2017

(54) CRYOGENIC REFRIGERATOR

(71) Applicant: Sumitomo Heavy Industries, Ltd., Tokyo (JP)

(72) Inventors: Mingyao Xu, Tokyo (JP); Qian Bao, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 272 days.

(21) Appl. No.: 14/677,235

(22) Filed: Apr. 2, 2015

(65) Prior Publication Data

US 2015/0285538 A1 Oct. 8, 2015

(30) Foreign Application Priority Data

Apr. 2, 2014 (JP) ..... 2014-076422

(51) Int. Cl.
*F25B 9/14* (2006.01)
*F25B 9/06* (2006.01)

(52) U.S. Cl.
CPC ..... *F25B 9/14* (2013.01); *F25B 9/06* (2013.01); *F25B 2309/14* (2013.01)

(58) Field of Classification Search
CPC ..... F25B 9/06; F25B 9/14; F25B 2309/14
See application file for complete search history.

(56) References Cited

U.S. PATENT DOCUMENTS 3,600,903 A * 8/1971 Chellis ..... F25B 9/14 62/6
2013/0174582 A1 7/2013 Xu et al.

FOREIGN PATENT DOCUMENTS

JP H02-143058 A 6/1990
JP 2011-017457 A 1/2011
JP 2013-142479 A 7/2013

* cited by examiner

*Primary Examiner* — Frantz Jules
*Assistant Examiner* — Brian King
(74) *Attorney, Agent, or Firm* — Michael Best & Friedrich LLP

(57) ABSTRACT

In a cryogenic refrigerator, a displacer has an internal space in which refrigerant gas flows. A cylinder houses the displacer to enable the displacer to perform reciprocating movement and forms an expansion space of the refrigerant gas between the cylinder and a bottom surface of the displacer. The displacer supplies the refrigerant gas to the expansion space during movement inside the cylinder from a bottom dead center to a top dead center. The displacer collects the refrigerant gas from the expansion space during movement inside the cylinder from the top dead center to the bottom dead center. A flow path resistance between the displacer and the expansion space is lower when the displacer is at the bottom dead center than when the displacer is at the top dead center.

6 Claims, 7 Drawing Sheets

CRYOGENIC REFRIGERATOR

RELATED APPLICATION

Priority is claimed to Japanese Patent Application No. 2014-76422, filed on Apr. 2, 2014, the entire content of which is incorporated herein by reference.

BACKGROUND OF THE INVENTION

1. Field of the Invention

The present invention relates to a cryogenic refrigerator generating Simon expansion with use of high-pressure refrigerant gas supplied from a compressor device to generate cryogenic temperatures.

2. Description of the Related Art

As an example of a refrigerator generating ultralow temperatures, a Gifford-McMahon (GM) refrigerator is known. In the GM refrigerator, a displacer performs reciprocating movement in a cylinder to change a volume of an expansion space. By selectively connecting the expansion space with a discharge side or an intake side of a compressor unit in accordance with this volume change, refrigerant gas expands in the expansion space. A cooled object is cooled by cold generated at this time.

SUMMARY OF THE INVENTION

An object of the present invention is to provide a technique to improve refrigeration performance of a cryogenic refrigerator.

According to an embodiment of the present invention, a cryogenic refrigerator includes a displacer that has an internal space in which refrigerant gas flows and a cylinder that houses the displacer to enable the displacer to perform reciprocating movement and forms an expansion space of the refrigerant gas between the cylinder and a bottom surface of the displacer. The displacer supplies the refrigerant gas to the expansion space during movement inside the cylinder from a bottom dead center to a top dead center and collects the refrigerant gas from the expansion space during movement inside the cylinder from the top dead center to the bottom dead center. A flow path resistance between the displacer and the expansion space is lower when the displacer is at the bottom dead center than when the displacer is at the top dead center.

Another embodiment of the present invention is also a cryogenic refrigerator. This cryogenic refrigerator includes a displacer that has an internal space in which refrigerant gas flows, and a cylinder that houses the displacer to enable the displacer to perform reciprocating movement and forms an expansion space of the refrigerant gas between the cylinder and a bottom surface of the displacer. A clearance is formed between a sidewall of the displacer and an inner wall of the cylinder and serves as a flow path of the refrigerant gas connecting the internal space of the displacer with the expansion space. The displacer supplies the refrigerant gas to the expansion space during upward movement inside the cylinder from a bottom dead center to a top dead center and collects the refrigerant gas from the expansion space during downward movement inside the cylinder from the top dead center to the bottom dead center. The clearance is formed so that a first average flow path resistance in a first half of the upward movement may be smaller than a second average flow path resistance in a second half of the upward movement.

BRIEF DESCRIPTION OF THE DRAWINGS

Embodiments will now be described, byway of example only, with reference to the accompanying drawings that are meant to be exemplary, not limiting, and wherein like elements are numbered alike in several figures, in which.

DETAILED DESCRIPTION OF THE INVENTION

The invention will now be described by reference to the preferred embodiments. This does not intend to limit the scope of the present invention, but to exemplify the invention.

In a refrigerator including a displacer such as a GM refrigerator, a clearance is provided between a cylinder and the displacer to allow the displacer to perform reciprocating movement in the cylinder. An end portion of the cylinder on a low temperature side is provided with a cooling stage, and a portion of the clearance functions as a heat exchanger performing heat exchange between refrigerant gas in the clearance and the cooling stage.

In general, in such a refrigerator, when the refrigerant gas expanding in an expansion space passes through the clearance and is exhausted from the expansion space, the refrigerant gas performs heat exchange with the cooling stage. On the other hand, the refrigerant gas to be supplied to the expansion space is not so cold as to cool the cooling stage. Thus, when the refrigerant gas is supplied to the expansion space, the refrigerant gas passes through the clearance having a large flow path resistance despite no contribution to refrigeration. This causes a pressure drop of the refrigerator and lowering of refrigeration performance of the refrigerator. Under such circumstances, a refrigerator according to an embodiment of the present invention is configured so that a flow resistance of a flow path formed between a displacer and an expansion space may be lower when the displacer is at a bottom dead center LP than when the displacer is at a top dead center UP.

Embodiments of the present invention will be described with reference to the drawings.

(First Embodiment)

Figure 1:
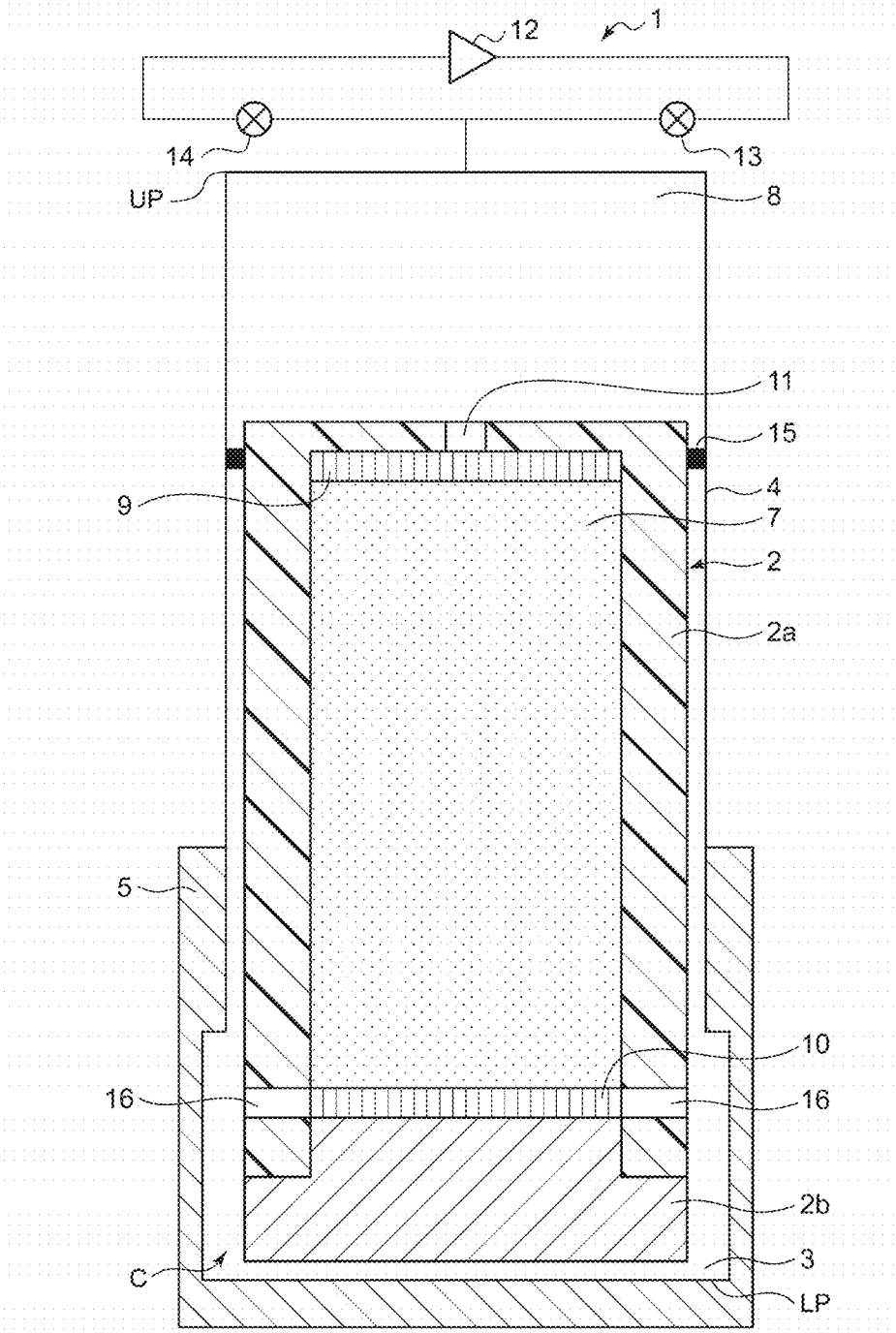
FIG. 1 is a schematic view illustrating a cryogenic refrigerator according to a first embodiment of the present invention.

FIG. 1 is a schematic view illustrating a cryogenic refrigerator 1 according to a first embodiment of the present invention. The cryogenic refrigerator 1 according to the first embodiment is, e.g., a Gifford-McMahon refrigerator using helium gas as refrigerant gas. The cryogenic refrigerator 1 includes a displacer 2, a cylinder 4 forming an expansion space 3 between the cylinder 4 and the displacer 2, and a bottomed cylindrical cooling stage 5 located adjacent to the expansion space 3 to externally cover the expansion space 3. The cooling stage 5 functions as a heat exchanger performing heat exchange between a cooled object and the refrigerant gas. The displacer 2 includes a main body portion 2*a* and a lid portion 2*b* provided at a low temperature end of the main body portion 2*a*. The lid portion 2*b* may be made of an equal material to that for the main body portion 2*a*. Alternatively, the lid portion 2*b* may be made of a material having higher heat conductivity than that for the main body portion 2*a*. In this case, the lid portion 2*b* also functions as a heat conductive portion performing heat exchange with the refrigerant gas flowing inside the lid portion 2*b*. For the lid portion 2*b*, a material having higher heat conductivity than that for at least the main body portion 2*a* is used such as copper, aluminum, and stainless steel. The cooling stage 5 is made of copper, aluminum, stainless steel, or the like, for example.

A compressor unit 12 collects the low-pressure refrigerant gas from an intake side, compresses it, and then supplies the high-pressure refrigerant gas to the cryogenic refrigerator 1. An example of the refrigerant gas to be used includes, without limitation, helium gas.

The cylinder 4 houses the displacer 2 to enable the displacer 2 to perform reciprocating movement in a longitudinal direction. For the cylinder 4, stainless steel is used, for example, from a viewpoint of strength, heat conductivity, helium blocking capability, and the like.

A high temperature end of the displacer 2 is provided with a not-illustrated Scotch yoke mechanism driving the displacer 2 in a reciprocating manner, and the displacer 2 performs reciprocating movement in an axial direction of the cylinder 4.

The displacer 2 has a cylindrical outer circumferential surface and is filled therein with a regenerator material. An inside space of the displacer 2 constitutes a regenerator 7. An upper end side and a lower end side of the regenerator 7 are provided with an upper end side flow straightener 9 and a lower end side flow straightener 10 straightening a flow of helium gas, respectively.

The high temperature end of the displacer 2 is provided with an upper opening 11 letting the refrigerant gas flow from a room temperature chamber 8 into the displacer 2. The room temperature chamber 8 is a space formed by the cylinder 4 and the high temperature end of the displacer 2 and changes a volume thereof along with reciprocating movement of the displacer 2.

To the room temperature chamber 8 is connected a common pipe for both intake and exhaust out of pipes mutually connecting the compressor unit 12, a supply valve 13, and a return valve 14 constituting an intake and exhaust system. Also, a seal 15 is attached between a portion of the displacer 2 on a high temperature end side and the cylinder 4.

The low temperature end of the displacer 2 is provided with a refrigerant gas outlet 16 guiding the refrigerant gas to the expansion space 3. Also, between an outer wall of the displacer 2 and an inner wall of the cylinder 4, a clearance C is formed to serve as a flow path of the refrigerant gas connecting an internal space of the displacer 2 with the expansion space 3.

The expansion space 3 is a space formed by the cylinder 4 and the displacer 2 and changes a volume thereof along with reciprocating movement of the displacer 2. At a position of an outer circumference and a bottom of the cylinder 4 corresponding to the expansion space 3 is the cooling stage 5, which is thermally connected to the cooled object. The refrigerant gas passes through the refrigerant gas outlet 16 and the clearance C and flows into the expansion space 3.

The main body portion 2*a* of the displacer 2 is made of phenolic resin or the like from a viewpoint of specific gravity, strength, heat conductivity, and the like. The regenerator material is formed of a wire mesh or the like. Meanwhile, FIG. 1 illustrates a state in which the cryogenic refrigerator 1 is in operation. Thus, outside diameters of the main body portion 2*a* and the lid portion 2*b* are equal along with slight contraction of the main body portion 2*a* due to a low temperature. However, at an ordinary temperature, the outside diameter of the lid portion 2*b* is slightly shorter than the outside diameter of the main body portion 2*a*.

Next, operations of the cryogenic refrigerator 1 will be described. At a certain time of a refrigerant gas supply process, the displacer 2 is located at a bottom dead center LP of the cylinder 4 as illustrated in FIG. 1. When the supply valve 13 is opened at the same time as or at a time slightly deviated from the point of time, the high-pressure refrigerant gas is supplied from the common pipe for both intake and exhaust into the cylinder 4 via the supply valve 13. As a result, the high-pressure refrigerant gas flows into the regenerator 7 inside the displacer 2 from the upper opening 11 located at an upper portion of the displacer 2. The high-pressure refrigerant gas flowing into the regenerator 7 is supplied to the expansion space 3 via the refrigerant gas outlet 16 located at a lower portion of the displacer 2 and the clearance C while being cooled by the regenerator material.

Figure 2:
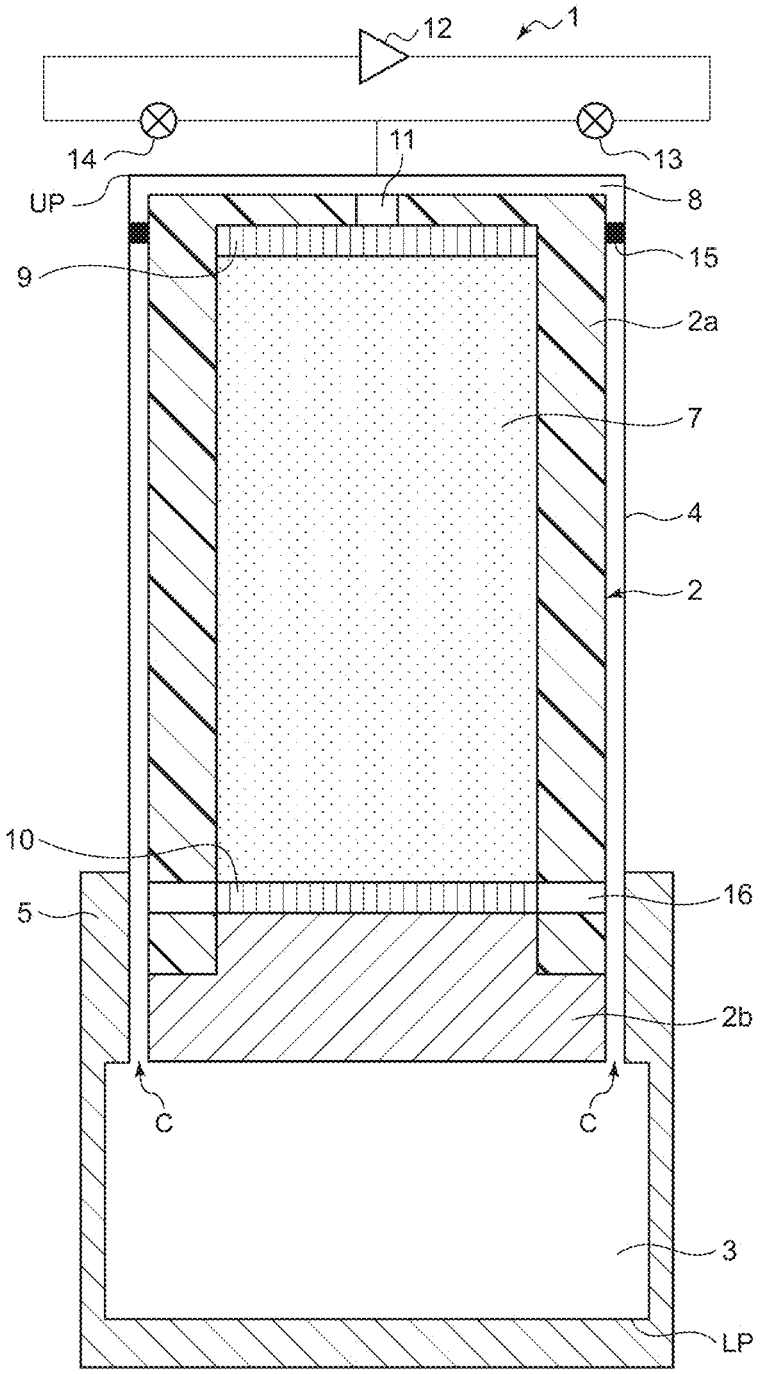
FIG. 2 is a schematic view illustrating a state in which a displacer is located at a top dead center UP in the cryogenic refrigerator according to the first embodiment.

When the expansion space 3 is filled with the high-pressure refrigerant gas, the supply valve 13 is closed. At this time, the displacer 2 is located at a top dead center UP inside the cylinder 4. FIG. 2 is a schematic view illustrating a state in which the displacer 2 is located at the top dead center UP in the cryogenic refrigerator 1 according to the first embodiment. When the return valve 14 is opened at the same time as or at a time slightly deviated from the time when the displacer 2 is located at the top dead center UP inside the cylinder 4, the refrigerant gas in the expansion space 3 is decompressed and expands. The refrigerant gas in the expansion space 3 that has reached a low temperature due to expansion absorbs heat of the cooling stage 5.

The displacer 2 moves toward the bottom dead center LP, and the volume of the expansion space 3 decreases. The refrigerant gas inside the expansion space 3 passes through the refrigerant gas outlet 16 and the clearance C and is collected in the displacer 2. At this time as well, the refrigerant gas absorbs heat of the cooling stage 5. The refrigerant gas that has returned from the expansion space 3 to the regenerator 7 cools the regenerator material inside the regenerator 7 as well. The refrigerant gas collected in the displacer 2 is then returned via the regenerator 7 and the upper opening 11 to the intake side of the compressor unit 12. The above process is regarded as one cycle, and the cryogenic refrigerator 1 cools the cooling stage 5 by repeating this cooling cycle.

In the cryogenic refrigerator 1 and the displacer 2 according to the first embodiment, heat coming from the cooling stage 5 goes into the lid portion 2*b* via the refrigerant gas existing in the expansion space 3. That is, when the low-temperature refrigerant gas generated in the expansion space 3 passes through the refrigerant gas outlet 16, heat exchange is performed between the refrigerant gas and the lid portion 2*b*.

Also, the heat going into the lid portion 2*b* is further transferred inside the lid portion 2*b* toward the expansion space 3. As described above, the lid portion 2*b* is provided at the low temperature end of the displacer 2. Hence, the lid portion 2*b* contacts the low-temperature refrigerant gas inside the expansion space 3, and heat exchange efficiency between the cooling stage 5 and the refrigerant gas can be further improved.

Meanwhile, the lid portion 2*b* of the displacer 2 may be made of phenolic resin or the like. However, in this case, heat exchange between the refrigerant gas and the lid is less performed than in the cryogenic refrigerator 1 according to the present embodiment, in which the lid portion 2*b* is made of a material having higher heat conductivity than that for the main body portion 2*a*, and the heat exchange is not substantially performed. Hence, cooling is performed only by heat exchange between the low-temperature refrigerant gas generated in the expansion space 3 and the cooling stage 5, which degrades the cooling efficiency. Accordingly, the lid portion 2*b* of the displacer 2 is preferably made of a material having higher heat conductivity than that for the main body portion 2*a*.

As described above, in the cryogenic refrigerator 1 according to the first embodiment, reciprocating movement of the displacer 2 inside the cylinder 4 causes the refrigerant gas inside the expansion space 3 to expand, which generates cold. As illustrated in FIG. 1, the clearance C is formed between the cylinder 4 and the displacer 2 for reciprocating movement of the displacer 2. A portion of the clearance C, which is adjacent to the cooling stage 5, functions as a heat exchanger performing heat exchange between the cooling stage 5 and the refrigerant gas in the clearance C.

Next, a flow path resistance between the displacer 2 and the expansion space 3 in the cryogenic refrigerator 1 according to the first embodiment will be described.

As described above, the displacer 2 collects the refrigerant gas from the expansion space 3 during movement in the cylinder 4 from the top dead center UP to the bottom dead center LP. The displacer 2 also supplies the refrigerant gas to the expansion space 3 during movement in the cylinder 4 from the bottom dead center LP to the top dead center UP.

When the displacer 2 collects the refrigerant gas from the expansion space 3, the refrigerant gas inside the expansion space 3 has a lower temperature than the cooling stage 5 due to expansion. The refrigerant gas passes through the clearance C and the refrigerant gas outlet 16, reaches the displacer 2 from the expansion space 3, and cools the cooling stage 5 during this time.

When the displacer 2 supplies the refrigerant gas to the expansion space 3, the refrigerant gas is cooled by the regenerator material of the regenerator 7. However, the refrigerant gas which is supplied from the displacer 2 to the expansion space 3 has a higher temperature than the refrigerant gas that the displacer 2 collects from the expansion space 3. Thus, the refrigerant gas to be supplied may not substantially contribute to cooling of the cooling stage 5. In a case in which the refrigerant gas that the displacer 2 supplies to the expansion space 3 has a higher temperature than the cooling stage 5, the refrigerant gas may give heat to the cooling stage 5.

In general, the heat exchange efficiency between the refrigerant gas and the cooling stage 5 is improved when flow speed of the refrigerant gas is increased. Since the amount of the refrigerant gas that the compressor unit 12 supplies is constant, the flow speed of the refrigerant gas is higher as a flow path area of the clearance C is smaller. Thus, when the refrigerant gas returns from the expansion space 3 to the displacer 2, the flow speed of the refrigerant gas is higher when the flow path area of the clearance C is smaller, which leads to improvement of the heat exchange efficiency. Especially, in the refrigerant gas collection process, in which the displacer 2 moves from the top dead center UP to the bottom dead center LP, the majority of the refrigerant gas to be exhausted from the expansion space 3 flows into the displacer 2 in the first half of the collection process. For this reason, it is preferable to improve the heat exchange efficiency especially in the first half of the refrigerant gas collection process (when the displacer 2 is located close to the top dead center UP). On the other hand, when the refrigerant gas flows into the expansion space 3 from the displacer 2, the flow path resistance of the clearance C is preferably low in order to reduce a pressure drop.

Under such circumstances, in the cryogenic refrigerator 1 according to the first embodiment, as illustrated in FIGS. 1 and 2, the clearance C between a sidewall of the displacer 2 and the inner wall of the cylinder 4 is provided to be larger when the displacer 2 is located at the bottom dead center LP than when the displacer 2 is located at the top dead center UP. As a result, the flow path area of the clearance C is larger when the displacer 2 is located at the bottom dead center LP than when the displacer 2 is located at the top dead center UP. Since the flow path resistance is higher as the flow path area of the clearance C is smaller, the flow path resistance between the displacer 2 and the expansion space 3 is lower when the displacer 2 is located at the bottom dead center LP than when the displacer 2 is located at the top dead center UP. Meanwhile, in the second half of the refrigerant gas collection process (when the displacer 2 is located close to the bottom dead center LP) as well, the refrigerant gas is exhausted from the expansion space 3. However, the amount of the refrigerant gas to be exhausted from the expansion space 3 in the second half of the collection process is smaller than the amount of the refrigerant gas to be exhausted from the expansion space 3 in the first half of the collection process. Thus, even in a case in which the heat exchange efficiency is lowered in the second half of the collection process, this has a very small effect on refrigeration performance.

On the other hand, the majority of the refrigerant gas to be supplied from the displacer 2 to the expansion space 3 is supplied in the first half of the supply process (when the displacer 2 is located close to the bottom dead center LP). Thus, to restrict the pressure drop, the flow path resistance of the clearance C in the first half of the supply process is preferably lowered. In other words, by configuring the cryogenic refrigerator 1 so that a first average value of the flow path resistance values of the clearance C in the first half of the collection process may be larger than a second average value of the flowpath resistance values in the second half, the heat exchange efficiency with the cooling stage 5 can be improved while restricting lowering of refrigeration capacity due to the pressure drop.

Based on the above description, in the cryogenic refrigerator 1 according to the first embodiment, when the refrigerant gas cools the cooling stage 5 in the first half of the refrigerant gas collection process, the flow speed of the refrigerant gas at the time of passing through the clearance C is high, which leads to an increase of the heat exchange efficiency in the heat exchanger. Also, since the flow path resistance when the refrigerant gas is supplied to the expansion space 3 is low, the pressure drop can be restricted. The cryogenic refrigerator 1 according to the first embodiment can improve refrigeration performance since the heat exchange efficiency in the heat exchanger is increased, and the pressure drop is reduced.

(Second Embodiment)

The cryogenic refrigerator 1 according to a second embodiment will be described. The cryogenic refrigerator 1 according to the second embodiment as well as the cryogenic refrigerator 1 according to the first embodiment is configured so that the flow path resistance between the displacer 2 and the expansion space 3 may be lower when the displacer 2 is at the bottom dead center LP than when the displacer 2 is at the top dead center UP. Hereinbelow, overlapping description with the cryogenic refrigerator 1 according to the first embodiment will arbitrarily be omitted or simplified.

Figure 3:
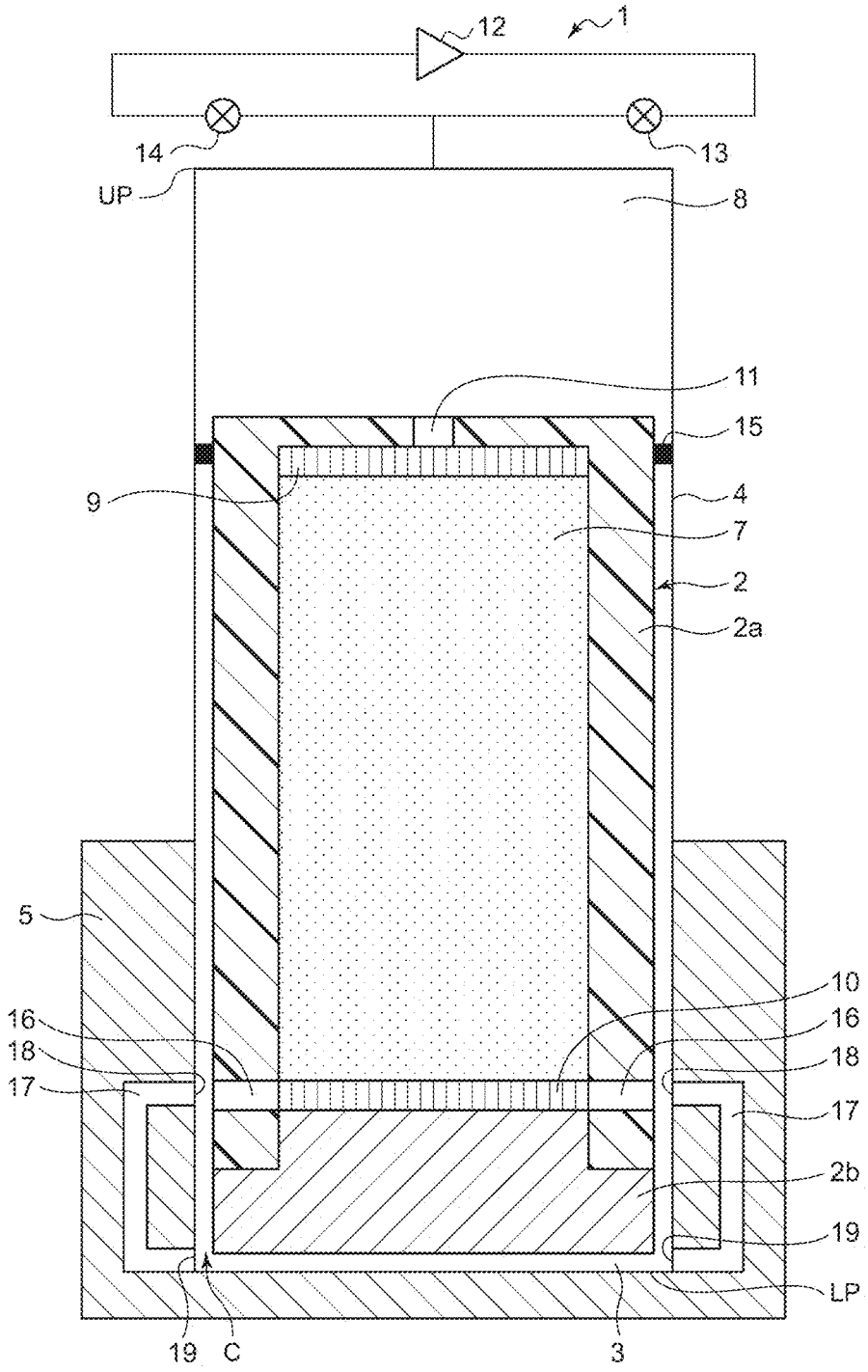
FIG. 3 is a schematic view illustrating a state in which the displacer is located at a bottom dead center LP in the cryogenic refrigerator according to a second embodiment of the present invention.

FIG. 3 is a schematic view illustrating the cryogenic refrigerator 1 according to the second embodiment of the present invention and illustrates a state in which the displacer 2 is located at the bottom dead center LP. As illustrated in FIG. 3, the cryogenic refrigerator 1 according to the second embodiment includes a bypass flow path 17 in a sidewall of the cylinder 4 or a sidewall of the cooling stage 5 constituting the expansion space 3. The bypass flow path 17 is a flow path in which a first opening 18 and a second opening 19 are ends thereof. Here, the first opening 18 is provided further on a side of the top dead center UP than the second opening 19, which means that the first opening 18 is located at an upper position closer to the top dead center UP than the second opening 19.

As illustrated in FIG. 3, when the displacer 2 is located at the bottom dead center LP, the first opening 18 is located at a position facing the refrigerant gas outlet 16. Thus, when the refrigerant gas is supplied from the displacer 2 to the expansion space 3, a large amount of the refrigerant gas flows from the first opening 18 into the bypass flow path 17. The refrigerant gas flowing into the bypass flow path 17 flows from the second opening 19 into the expansion space 3. Also, part of the refrigerant gas flows into the expansion space 3 through the clearance C in a similar manner to that in the cryogenic refrigerator 1 according to the first embodiment.

In this manner, in the cryogenic refrigerator 1 according to the second embodiment, when the refrigerant gas is supplied from the displacer 2 to the expansion space 3, two flow paths from the displacer 2 to the expansion space 3 exist: the clearance C and the bypass flow path 17. Thus, the flow path resistance between the displacer 2 and the expansion space 3 is lower than in a case in which only the clearance C exists as the flow path from the displacer 2 to the expansion space 3. Meanwhile, it is preferable to set the flow path area of the bypass flow path 17 to be larger than the flow path area of the clearance C since doing so causes the flow path resistance between the displacer 2 and the expansion space 3 to be lowered.

Figure 4:
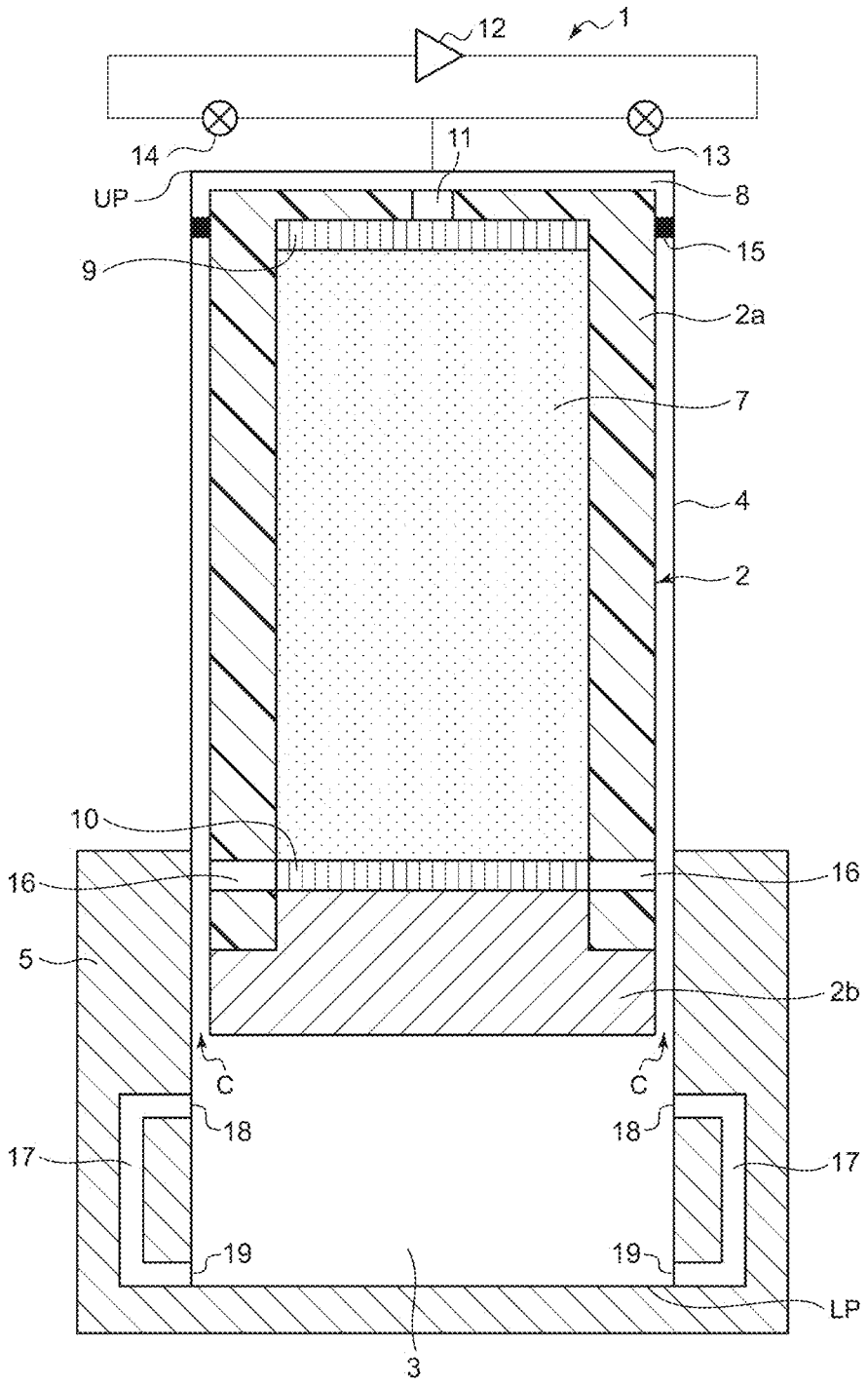
FIG. 4 is a schematic view illustrating a state in which the displacer is located at the top dead center UP in the cryogenic refrigerator according to the second embodiment of the present invention.

FIG. 4 is a schematic view illustrating the cryogenic refrigerator 1 according to the second embodiment of the present invention and illustrates a state in which the displacer 2 is located at the top dead center UP. As illustrated in FIG. 4, when the displacer 2 is located at the top dead center UP, the first opening 18 is located further on a side of the bottom dead center LP than the refrigerant gas outlet 16. In other words, when the displacer 2 is located at the top dead center UP, the refrigerant gas outlet 16 is located at an upper position further away from the bottom dead center LP than the first opening 18.

As described above, when the displacer 2 is located at the top dead center UP, the refrigerant gas is collected from the expansion space 3 in the displacer 2 while cooling the cooling stage 5. At this time, only the clearance C exists as the flow path of the refrigerant gas from the expansion space 3 to the displacer 2. Thus, the flow path resistance between the displacer 2 and the expansion space 3 is higher when the displacer 2 is at the top dead center UP than when the displacer 2 is at the bottom dead center LP. Consequently, the flow speed when the refrigerant gas passes through the clearance C at the time of being collected from the expansion space 3 to the displacer 2 is increased, and the cooling efficiency of the cooling stage 5 is improved.

From a viewpoint of increasing the flow path resistance between the displacer 2 and the expansion space 3 while the refrigerant gas is collected from the expansion space 3 in the displacer 2, the distance between the first opening 18 and the refrigerant gas outlet 16 when the displacer 2 is located at the top dead center UP is preferably longer. To do so, as illustrated in FIG. 4, the first opening 18 may be located further on the side of the bottom dead center LP than the lid portion 2*b* serving as a bottom surface of the displacer 2 when the displacer 2 is located at the top dead center UP. The lid portion 2*b* or the bottom surface of the displacer 2 is located at an upper position further away from the bottom dead center LP than the first opening 18 when the displacer 2 is located at the top dead center UP.

More preferably, as illustrated in FIG. 3, this is established together with locating the first opening 18 at the position facing the refrigerant gas outlet 16 when the displacer 2 is located at the bottom dead center LP. This can be achieved by setting the distance from the refrigerant gas outlet 16 to the bottom surface of the displacer 2 to be shorter than the stroke length of the displacer 2. Thus, while the refrigerant gas returns from the expansion space 3 to the displacer 2, the flow path resistance between the displacer 2 and the expansion space 3 can be high. In addition, when the displacer 2 reaches the bottom dead center LP to start supply of the refrigerant gas from the displacer 2 to the expansion space 3, the flow path resistance between the displacer 2 and the expansion space 3 can be low.

Meanwhile, as illustrated in FIGS. 3 and 4, the second opening 19 is provided as high as a bottom surface of the expansion space 3 or the bottom dead center LP. When supply of the refrigerant gas from the displacer 2 to the expansion space 3 is started, the displacer 2 moves from the bottom dead center LP toward the top dead center UP. Thus, immediately after the start of supply of the refrigerant gas, the lid portion 2*b* of the displacer 2 opposed to the second opening 19 moves further on the side of the top dead center than the second opening 19, which means that the lid portion 2*b* moves upward away from the second opening 19.

Here, the second opening 19 is an exit of the bypass flow path 17 at the time of supply of the refrigerant gas. That is, the fact that the lid portion 2*b* ceases to be opposed to the second opening 19 immediately after the start of supply of the refrigerant gas means that the flow path resistance around the exit of the bypass flow path 17 is lowered. Accordingly, the flow path resistance between the displacer 2 and the expansion space 3 at the time of supply of the refrigerant gas can be lowered.

Based on the above description, in the cryogenic refrigerator 1 according to the second embodiment, the flow speed of the refrigerant gas in the first half of the refrigerant gas collection process is high, which leads to an increase of the heat exchange efficiency in the heat exchanger. Also, since the refrigerant gas passes through the bypass flow path 17 and flows into the expansion space 3, the flow path resistance between the displacer 2 and the expansion space 3 in the first half of the refrigerant gas supply process is low, and the pressure drop can be restricted. The cryogenic refrigerator 1 according to the second embodiment can improve refrigeration performance since the heat exchange efficiency in the heat exchanger is increased, and the pressure drop is reduced.

(Third Embodiment)

The cryogenic refrigerator 1 according to a third embodiment of the present invention will be described. The cryogenic refrigerator 1 according to the third embodiment as well as the cryogenic refrigerator 1 according to the first embodiment and the cryogenic refrigerator 1 according to the second embodiment is configured so that the flow path resistance between the displacer 2 and the expansion space 3 may be lower when the displacer 2 is at the bottom dead center LP than when the displacer 2 is at the top dead center UP. Hereinbelow, overlapping description with the cryogenic refrigerator 1 according to the first embodiment or the cryogenic refrigerator 1 according to the second embodiment will arbitrarily be omitted or simplified.

Figure 5:
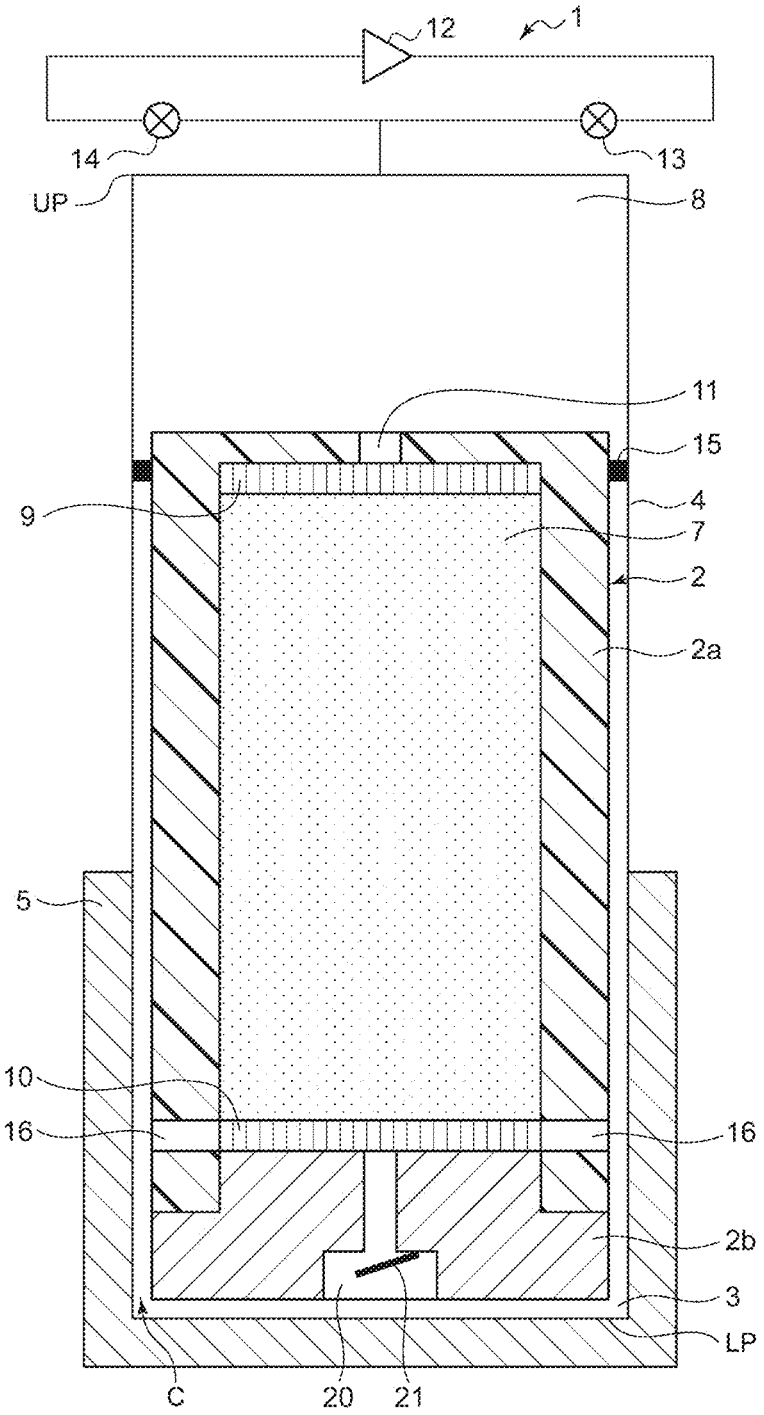
FIG. 5 is a schematic view illustrating a state in which the displacer is located at the bottomdead center LP in the cryogenic refrigerator according to a third embodiment of the present invention.

FIG. 5 is a schematic view illustrating the cryogenic refrigerator 1 according to the third embodiment of the present invention and illustrates a state in which the displacer 2 is located at the bottom dead center LP. As illustrated in FIG. 5, the cryogenic refrigerator 1 according to the third embodiment includes a second bypass flow path 20 provided in the lid portion 2*b* serving as the bottom surface of the displacer 2. The second bypass flow path 20 is a flow path of the refrigerant gas connecting the internal space (i.e., the regenerator 7) of the displacer 2 with the expansion space 3.

When the displacer 2 is located at the bottom dead center LP, supply of the refrigerant gas from the displacer 2 to the expansion space 3 starts. At this time, two routes for supplying the refrigerant gas from the displacer 2 to the expansion space 3 exist: a route of passing through the refrigerant gas outlet 16 and the clearance C and a route of passing through the second bypass flow path 20. Thus, the flow path resistance between the displacer 2 and the expansion space 3 is lower than in a case in which only the clearance C exists as the flow path from the displacer 2 to the expansion space 3.

A check valve 21 is provided in the middle of the second bypass flow path 20 or at an end of the second bypass flow path 20 on a side of the expansion space 3. The check valve 21 prevents the refrigerant gas from passing and flowing through the second bypass flow path 20 from the expansion space 3 into the displacer 2. That is, the second bypass flow path 20 is a one-way flow path from the displacer 2 toward the expansion space 3.

Figure 6:
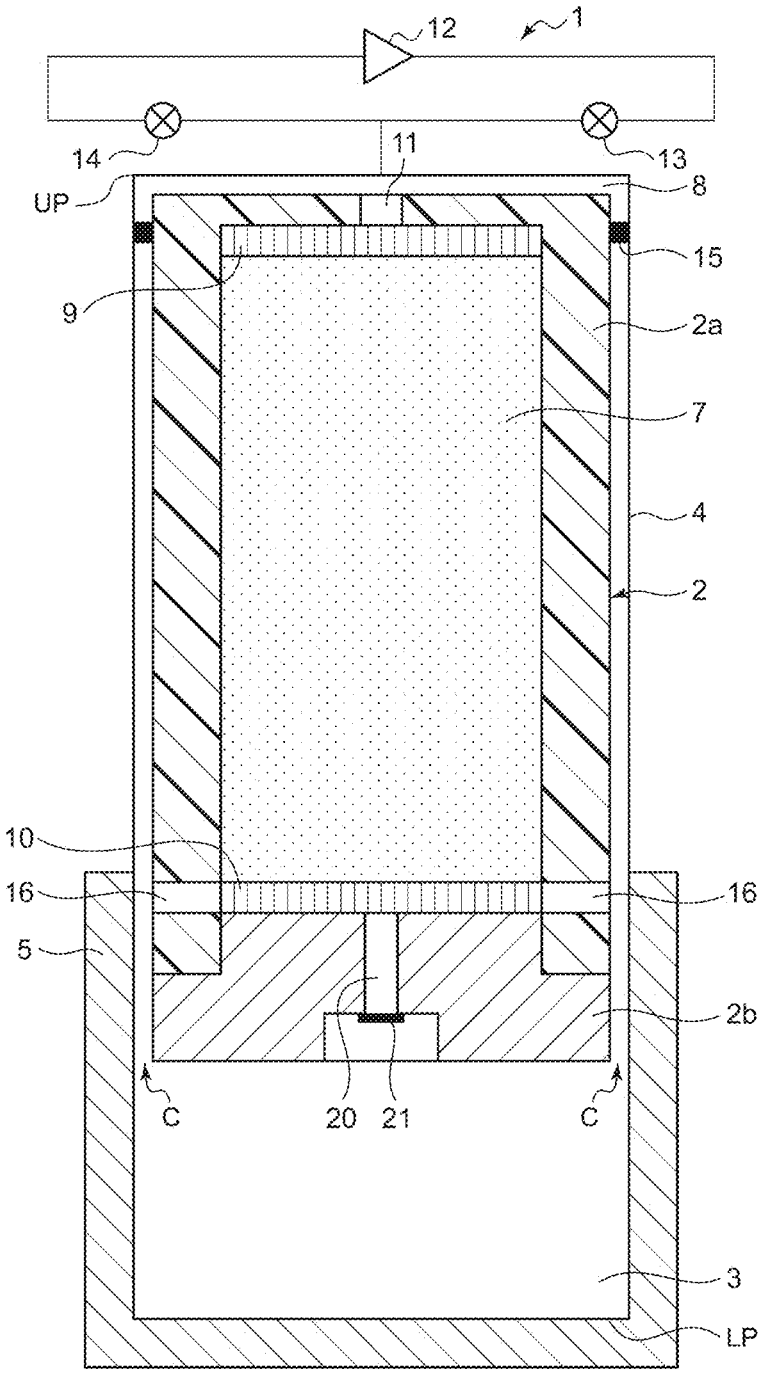
FIG. 6 is a schematic view illustrating a state in which the displacer is located at the top dead center UP in the cryogenic refrigerator according to the third embodiment of the present invention.

FIG. 6 is a schematic view illustrating the cryogenic refrigerator 1 according to the third embodiment of the present invention and illustrates a state in which the displacer 2 is located at the top dead center UP. As described above, when the displacer 2 is located at the top dead center UP, the refrigerant gas in the expansion space 3 is collected in the displacer 2. At this time, since the check valve 21 prevents the refrigerant gas from passing and flowing through the second bypass flow path 20 from the expansion space 3 into the displacer 2, only the route of passing through the clearance C and the refrigerant gas outlet 16 exists as the route for collecting the refrigerant gas from the expansion space 3 to the displacer 2. Thus, the flow path resistance between the displacer 2 and the expansion space 3 is higher when the displacer 2 is at the top dead center UP than when the displacer 2 is at the bottom dead center LP. Consequently, the flow speed when the refrigerant gas returns from the expansion space 3 to the displacer 2 is increased, and the cooling efficiency between the refrigerant gas and the cooling stage 5 is improved.

Based on the above description, in the cryogenic refrigerator 1 according to the third embodiment, when the refrigerant gas cools the cooling stage 5 in the first half of the refrigerant gas collection process, the refrigerant gas passes through the clearance C only. Thus, the flow speed of the refrigerant gas in the first half of the refrigerant gas collection process is high, which leads to an increase of the heat exchange efficiency in the heat exchanger. Also, in the first half of the refrigerant gas supply process, the refrigerant gas passes through both the routes: the second bypass flow path 20 and the clearance C and flows into the expansion space 3. Thus, the flow path resistance between the displacer 2 and the expansion space 3 in the first half of the refrigerant gas supply process is low, and the pressure drop can be restricted. Accordingly, the cryogenic refrigerator 1 according to the third embodiment can improve refrigeration performance since the heat exchange efficiency in the heat exchanger is increased, and the pressure drop is reduced.

(Fourth Embodiment)

The cryogenic refrigerator 1 according to a fourth embodiment of the present invention will be described. Hereinbelow, overlapping description with the cryogenic refrigerator 1 according to the first embodiment, the cryogenic refrigerator 1 according to the second embodiment, or the cryogenic refrigerator 1 according to the third embodiment will arbitrarily be omitted or simplified.

The cryogenic refrigerator 1 according to the fourth embodiment as well as the cryogenic refrigerator 1 according to the first embodiment, the cryogenic refrigerator 1 according to the second embodiment, and the cryogenic refrigerator 1 according to the third embodiment is configured so that the flow path resistance between the displacer 2 and the expansion space 3 may be lower when the displacer 2 is at the bottom dead center LP than when the displacer 2 is at the top dead center UP.

Figure 7:
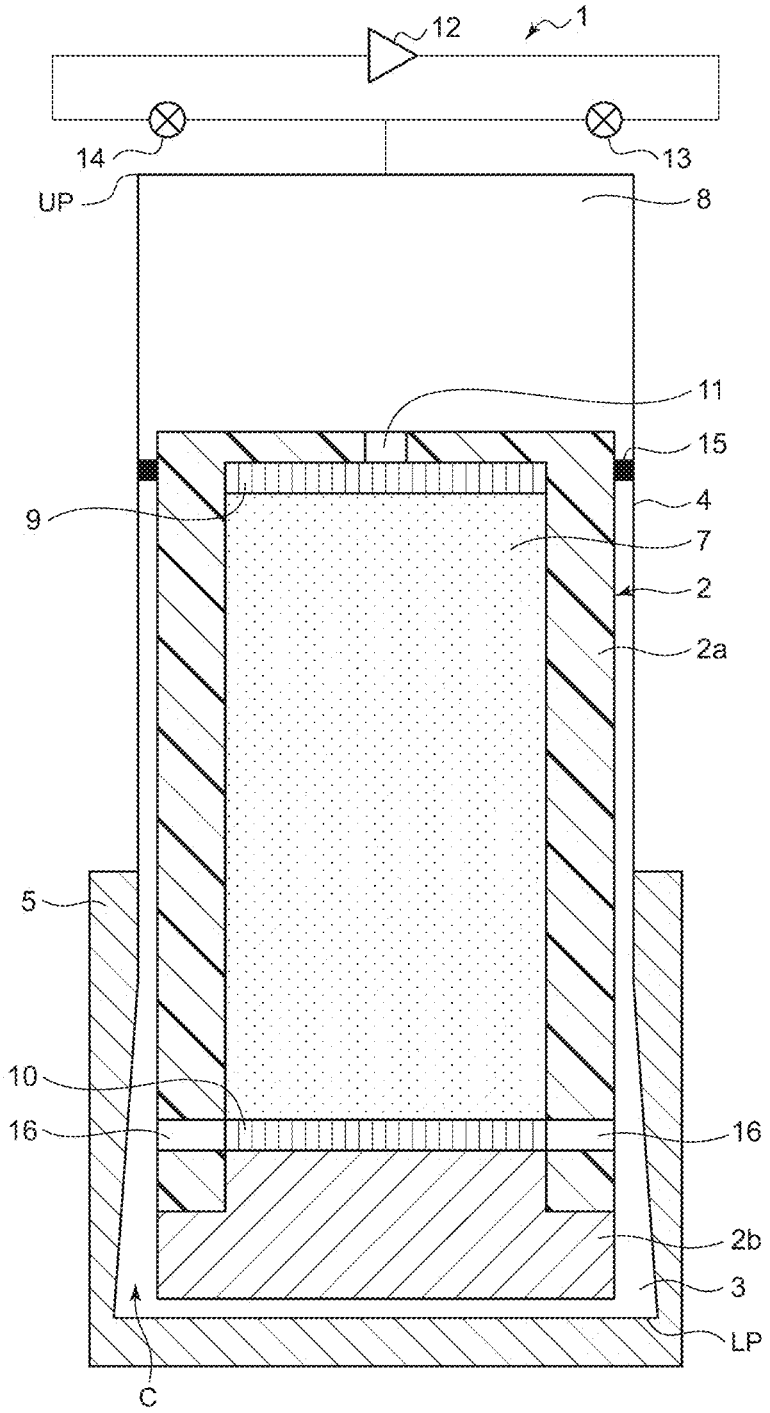
FIG. 7 is a schematic view illustrating a state in which the displacer is located at the bottomdead center LP in the cryogenic refrigerator according to a fourth embodiment of the present invention.

FIG. 7 is a schematic view illustrating the cryogenic refrigerator 1 according to the fourth embodiment of the present invention and illustrates a state in which the displacer 2 is located at the bottom dead center LP. As illustrated in FIG. 7, in the cryogenic refrigerator 1 according to the fourth embodiment, the flow path area of the clearance C at a position of the refrigerant gas outlet 16 is the largest when the displacer 2 is located at the bottom dead center LP. Also, the flow path area of the clearance C at a position of the refrigerant gas outlet 16 is the smallest when the displacer 2 is located at the top dead center UP. The cryogenic refrigerator 1 according to the fourth embodiment is configured so that the flow path area of the clearance C may continuously decrease from the largest position to the smallest position.

In this manner, in the clearance C in the cryogenic refrigerator 1 according to the fourth embodiment, when the displacer 2 moves inside the cylinder 4 from the bottom dead center LP to the top dead center UP, the average value of the flow path resistance values in the first half of the movement is smaller than the average value of the flow path resistance values in the second half of the movement. Here, "the first half of the movement" means movement in the first half when the displacer 2 moves from the bottom dead center LP to the top dead center UP or from the top dead center UP to the bottom dead center LP. Similarly, "the second half of the movement" means movement in the second half when the displacer 2 moves from the bottom dead center LP to the top dead center UP or from the top dead center UP to the bottom dead center LP.

In the cryogenic refrigerator 1 according to the fourth embodiment, when the displacer 2 moves from the bottom dead center LP to the top dead center UP in the refrigerant gas supply process, the flow path resistance of the clearance C is low, and the pressure drop is restricted. On the other hand, when the refrigerant gas cools the cooling stage 5, that is, in the refrigerant gas collection process, the flow speed of the refrigerant gas is high, which leads to an increase of the heat exchange efficiency in the heat exchanger. In this manner, the cryogenic refrigerator 1 according to the fourth embodiment can improve refrigeration performance since the heat exchange efficiency in the heat exchanger is increased, and the pressure drop is reduced.

As described above, with the cryogenic refrigerator 1 according to each of the embodiments, the pressure drop in the heat exchanger can be reduced.

The present invention has been described above based on the several embodiments. These embodiments only illustrate the principle and the application of the present invention. New embodiments generated by arbitrary combination of these embodiments are included in the present invention. For example, the second bypass flow path 20 and the check valve 21 according to the third embodiment may be combined with the cryogenic refrigerator 1 according to the first embodiment or the cryogenic refrigerator 1 according to the second embodiment.

Also, various modification examples and arrangement changes are available to the above embodiments without departing from the spirit and the scope of the present invention specified in the claims.

For example, in the aforementioned cryogenic refrigerator 1, the number of stages is one. However, the number of stages can arbitrarily be selected such as two or more. Also, in each of the embodiments, the cryogenic refrigerator is a GM refrigerator. However, the type is not limited to this. For example, the present invention can be applied to any refrigerator including a displacer such as a Stirling refrigerator and a Solvay refrigerator.

In the cryogenic refrigerator 1 according to any of the above respective embodiments, the flow path resistance between the displacer 2 and the expansion space 3 is lower when the displacer 2 is located at the bottom dead center LP than when the displacer 2 is located at the top dead center UP. Alternatively, the flow path resistance between the displacer 2 and the expansion space 3 when the displacer 2 is located at the bottom dead center LP and the flow path resistance between the displacer 2 and the expansion space 3 when the displacer 2 is located at the top dead center UP may be equal. In this case, the cryogenic refrigerator has only to be configured so that, when the displacer 2 moves inside the cylinder 4 from the bottom dead center to the top dead center, the average value of the flowpath resistance values of the clearance C in the first half of the movement maybe smaller than the average value of the flow path resistance values in the second half of the movement.

For example, suppose that the flow path area of the clearance C at a position of the refrigerant gas outlet 16 when the displacer 2 is located at the bottom dead center LP is not different from the flow path area when the displacer 2 is located at the top dead center UP. Even in this case, the flow path area of the clearance C at a position of the refrigerant gas outlet 16 has only to be larger than the flow path area when the displacer 2 is located at the bottom dead center LP as the displacer 2 moves from the bottom dead center LP toward the top dead center UP. By doing so, when the displacer 2 moves inside the cylinder 4 from the bottom dead center LP to the top dead center UP, the average value of the flow path resistance values of the clearance C in the first half of the movement is smaller than the average value of the flowpath resistance values in the second half of the movement.

According to the above configuration, when the refrigerant gas flows from the displacer 2 into the expansion space 3, that is, in the refrigerant gas supply process, the flow path resistance of the clearance is low, and the pressure drop is restricted in the first half thereof. On the other hand, when the refrigerant gas cools the cooling stage 5, that is, in the refrigerant gas collection process, the flow speed of the refrigerant gas flowing in the clearance C is high in the first half thereof, which leads to an increase of the heat exchange efficiency in the heat exchanger. In this manner, the cryogenic refrigerator 1 according to each of the above respective embodiments can improve refrigeration performance since the heat exchange efficiency in the heat exchanger is increased, and the pressure drop is reduced.

It should be understood that the invention is not limited to the above-described embodiment, but may be modified into various forms on the basis of the spirit of the invention. Additionally, the modifications are included in the scope of the invention.

What is claimed is:

1. A cryogenic refrigerator comprising:

a displacer comprising an axially extending displacer sidewall and a displacer bottom arranged at an end of the axially extending displacer sidewall, the axially extending displacer sidewall and the displacer bottom in combination surrounding a displacer internal space in which refrigerant gas flows, the axially extending displacer sidewall comprising a displacer sidewall gas outlet formed through the displacer sidewall to guide the refrigerant gas from or into the displacer internal space;

a cylinder that houses the displacer to enable the displacer to perform axial reciprocating movement along an axial direction of the cylinder; and a cooling stage connected to the cylinder to surround the displacer bottom such that an expansion space of the refrigerant gas is formed between the displacer bottom and the cooling stage; wherein the expansion space is at a maximum volume when the displacer is at a top dead center of the axial reciprocating movement and the expansion space is at a minimum volume when the displacer is at a bottom dead center of the axial reciprocating movement, when the displacer is at the top dead center of the axial reciprocating movement, a first flow path is formed between the displacer and the cooling stage to fluidly couple the displacer sidewall gas outlet to the expansion space, the first flow path having a first flow path resistance between the displacer and the expansion space, when the displacer is at the bottom dead center of the axial reciprocating movement, a second flow path is formed between the displacer and the cooling stage to fluidly couple the displacer sidewall gas outlet to the expansion space, the second flow path having a second flow path resistance between the displacer and the expansion space, the second flow path resistance is lower than the first flow path resistance.

2. The cryogenic refrigerator according to claim 1, wherein the cooling stage comprises an upper cylindrical part and a lower cylindrical part, when the displacer is at the top dead center of the axial reciprocating movement, a first clearance having a first clearance width is formed between the displacer and the upper cylindrical part of the cooling stage to fluidly couple the displacer sidewall gas outlet to the expansion space, when the displacer is at the bottom dead center of the axial reciprocating movement, a second clearance having a second clearance width is formed between the displacer and the lower cylindrical part of the cooling stage to fluidly couple the displacer sidewall gas outlet to the expansion space, the second clearance width is greater than the first clearance width.

3. The cryogenic refrigerator according to claim 1, wherein the cooling stage comprises an upper cylindrical part and a lower cylindrical part, the lower cylindrical part of the cooling stage comprises a bypass flow path for the refrigerant gas in which a first opening and a second opening are ends thereof, when the displacer is at the top dead center of the axial reciprocating movement, the first opening is at a position that is lower than the displacer sidewall gas outlet and the second opening is at a lower position than the first opening.

4. The cryogenic refrigerator according to claim 3, wherein the second opening is below the displacer bottom when the displacer is at the top dead center of the axial reciprocating movement.

5. The cryogenic refrigerator according to claim 3, wherein the first opening is provided at a position facing the displacer sidewall gas outlet when the displacer is at the bottom dead center.

6. The cryogenic refrigerator according to claim 3, wherein the second opening is provided as high as a bottom surface of the expansion space.

* * * * *